US009963812B2

(12) United States Patent
Roche

(10) Patent No.: US 9,963,812 B2
(45) Date of Patent: May 8, 2018

(54) QUILTING SYSTEMS AND METHODS

(71) Applicant: Great Notions News Company, Dallas, TX (US)

(72) Inventor: Eileen Katherine Roche, Flower Mound, TX (US)

(73) Assignee: Great Notions News Company, Dallas, TX (US)

( * ) Notice: Subject to any disclaimer, the term of this patent is extended or adjusted under 35 U.S.C. 154(b) by 899 days.

(21) Appl. No.: 14/053,181

(22) Filed: Oct. 14, 2013

(65) Prior Publication Data

US 2015/0101520 A1 Apr. 16, 2015

(51) Int. Cl.
*D05B 11/00* (2006.01)
*D05B 75/00* (2006.01)

(52) U.S. Cl.
CPC ..... *D05B 11/00* (2013.01); *D05B 75/00* (2013.01)

(58) Field of Classification Search
CPC ..... D04B 11/00
USPC ..... 112/470.13, 470.12, 117, 119; 38/102.3, 38/102.2, 102.4
See application file for complete search history.

(56) References Cited

U.S. PATENT DOCUMENTS 321,009 A * 6/1885 Davis ..... D05B 11/00 112/119
334,646 A * 1/1886 Davis ..... D05B 11/00 112/119
360,846 A * 4/1887 Bernheim ..... D05B 11/00 112/119
372,911 A * 11/1887 Hill ..... D05B 11/00 112/119
453,179 A * 6/1891 Davis ..... D05B 11/00 112/119
566,049 A * 8/1896 Wolford ..... D05C 1/02 38/102.21
672,809 A * 4/1901 Russell ..... D05C 1/02 38/102.21
1,944,690 A * 1/1934 Karle ..... D05C 1/04 112/103
4,192,241 A * 3/1980 Reed ..... D05B 11/00 112/117
4,247,998 A * 2/1981 Foss ..... D05C 9/04 112/103
4,665,638 A * 5/1987 Morton ..... D05C 1/02 242/538
4,677,775 A * 7/1987 Riley ..... B44D 3/185 160/380
4,736,535 A * 4/1988 Rucker ..... D05C 1/02 248/172
4,969,410 A * 11/1990 Brower ..... D05B 11/00 112/117
4,993,333 A * 2/1991 Moore, III ..... D05C 9/04 112/103

(Continued)

*Primary Examiner* — Danny Worrell
(74) *Attorney, Agent, or Firm* — Hubbard Johnston, PLLC

(57) ABSTRACT

Apparatuses, systems and methods for quilting are provided. In an illustrative embodiment, a quilt support includes a platform adapted to support an embroidery machine capable of quilting a quilt sandwich. A first support arm is coupled to the platform. The first support arm is adapted to support a portion of the quilt sandwich. A second support arm is coupled to the platform. The second support arm is offset from the first support arm and adapted to support a portion of the quilt sandwich. Apparatuses, systems and methods are provided.

16 Claims, 8 Drawing Sheets

(56) References Cited

U.S. PATENT DOCUMENTS

| | | | | | |
|---|---|---|---|---|---|
| 5,353,725 | A * | 10/1994 | Sakakibara | D05C 9/04 | 112/103 |
| 5,711,236 | A * | 1/1998 | Badger | D05B 11/00 | 112/117 |
| 5,870,840 | A * | 2/1999 | Geils | D05C 1/02 | 38/102.21 |
| 6,151,816 | A * | 11/2000 | Bagley | D05C 1/02 | 38/102.21 |
| 6,615,756 | B2 * | 9/2003 | Barrus | D05B 11/00 | 112/119 |
| 6,631,688 | B1 * | 10/2003 | Maag | D05B 11/00 | 112/118 |
| 6,792,884 | B1 * | 9/2004 | Barrus | D05B 11/00 | 112/119 |
| 6,932,007 | B1 * | 8/2005 | Beauchamp | D05B 11/00 | 112/117 |
| 6,932,008 | B2 * | 8/2005 | Pfeifer | D05B 39/005 | 112/117 |
| 6,951,178 | B2 * | 10/2005 | Watts | D05B 11/00 | 112/118 |
| 6,990,914 | B2 * | 1/2006 | Canan | D05B 11/00 | 112/119 |
| 7,011,031 | B1 * | 3/2006 | Bradley | D05B 11/00 | 112/119 |
| 8,166,897 | B2 * | 5/2012 | Bowers | D05B 11/00 | 112/119 |
| 9,145,630 | B2 * | 9/2015 | McCoy | D05B 11/00 | |

* cited by examiner

QUILTING SYSTEMS AND METHODS

TECHNICAL FIELD

The illustrative embodiments relate generally to quilting and embroidery and more particularly to apparatuses and methods for quilting and embroidery.

BACKGROUND

Quilting is a process that generally includes joining two or more layers together by use of a needle and thread to form a quilt. Embroidery is a process for decorating or stitching a workpiece by use of a needle and thread. Both processes are separate and distinct—quilting may be constructive and embroidery may be decorative. As such, when automated, separate machines may be required for each process. However, obtaining and maintaining such machines can be costly. Additionally, each machine requires a certain amount of floor space.

SUMMARY

According to an illustrative embodiment, a quilt support comprises: a platform adapted to support an embroidery machine capable of quilting a quilt sandwich; a first support arm coupled to the platform, the first support arm adapted to support a portion of the quilt sandwich; and a second support arm coupled to the platform, the second support arm offset from the first support arm and adapted to support a portion of the quilt sandwich.

According to another illustrative embodiment, a quilting system comprises: an embroidery machine capable of quilting a quilt sandwich; a first support arm adjacent to the embroidery machine, the first support arm adapted to support a portion of the quilt sandwich; and a second support arm adjacent to the embroidery machine and offset from the first support arm such that the embroidery machine is between the first support arm and second support arm, the second support arm adapted to support a portion of the quilt sandwich.

In yet another illustrative embodiment, a method for quilting a quilt sandwich with an embroidery machine comprises: supporting a first portion of a quilt sandwich with a first support arm; supporting a second portion of a quilt sandwich with a second support arm; and quilting a third portion of a quilt sandwich between the first quilt sandwich portion and second quilt sandwich portion with an embroidery machine.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore not to be taken in a limiting sense, and the scope of the illustrative embodiments are defined only by the appended claims. In addition, unless otherwise indicated, as used herein, "or" does not require mutual exclusivity.

Figure 1:
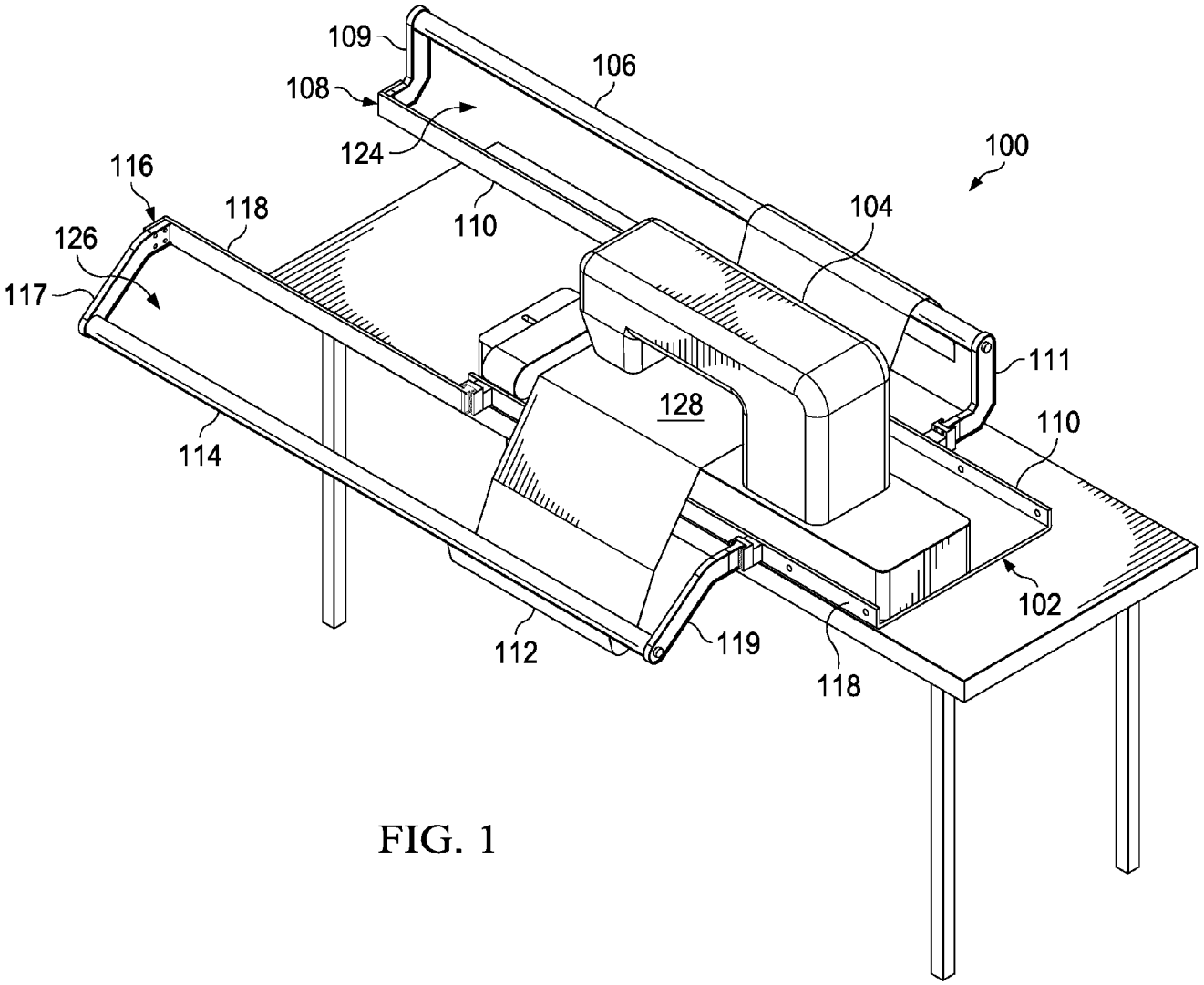
FIG. 1 is a schematic perspective view of a quilt support and embroidery machine.
Figure 2:
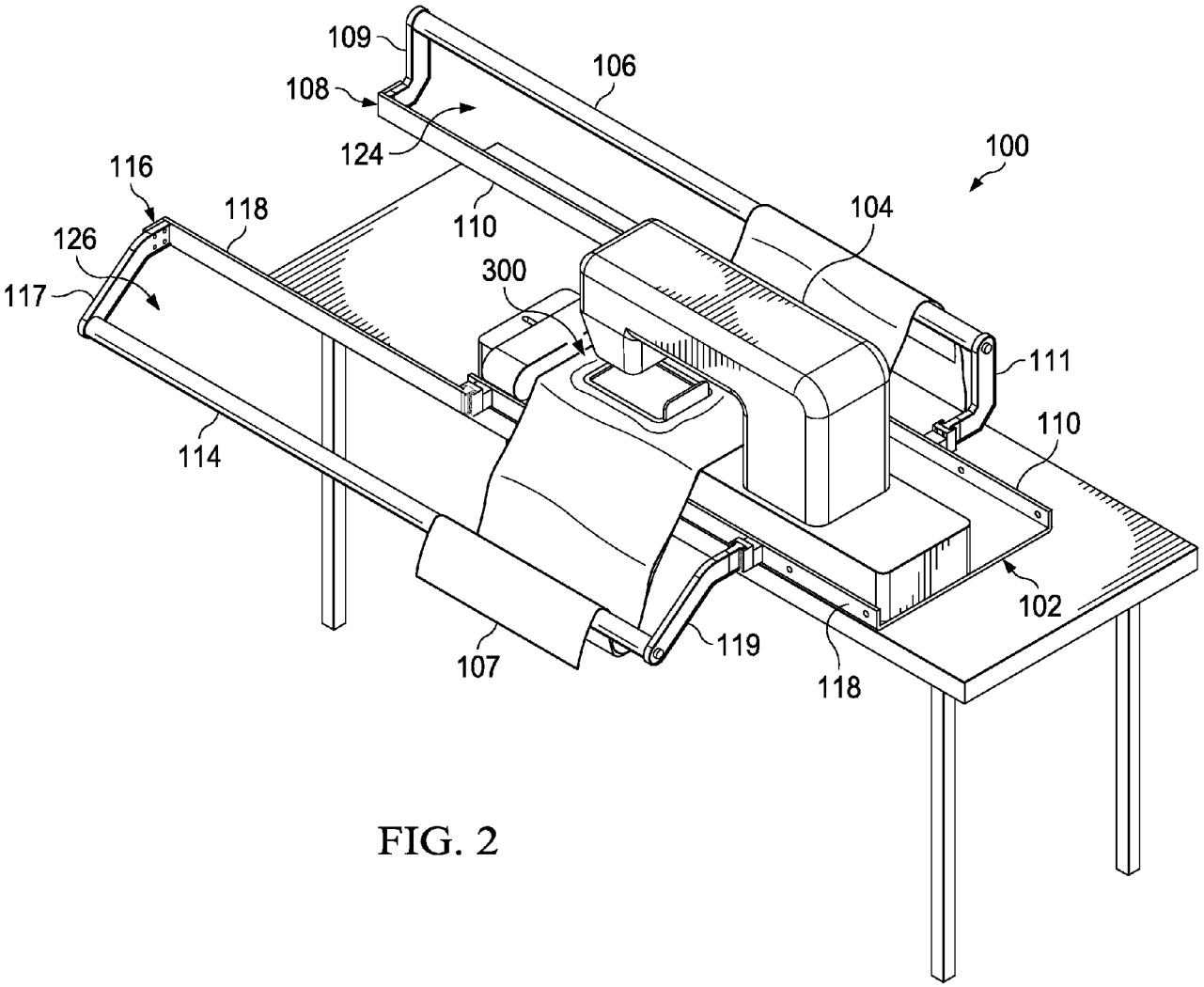
FIG. 2 is a schematic perspective view of the quilt support and embroidery machine of FIG. 1 with a quilt sandwich.
Figure 3:
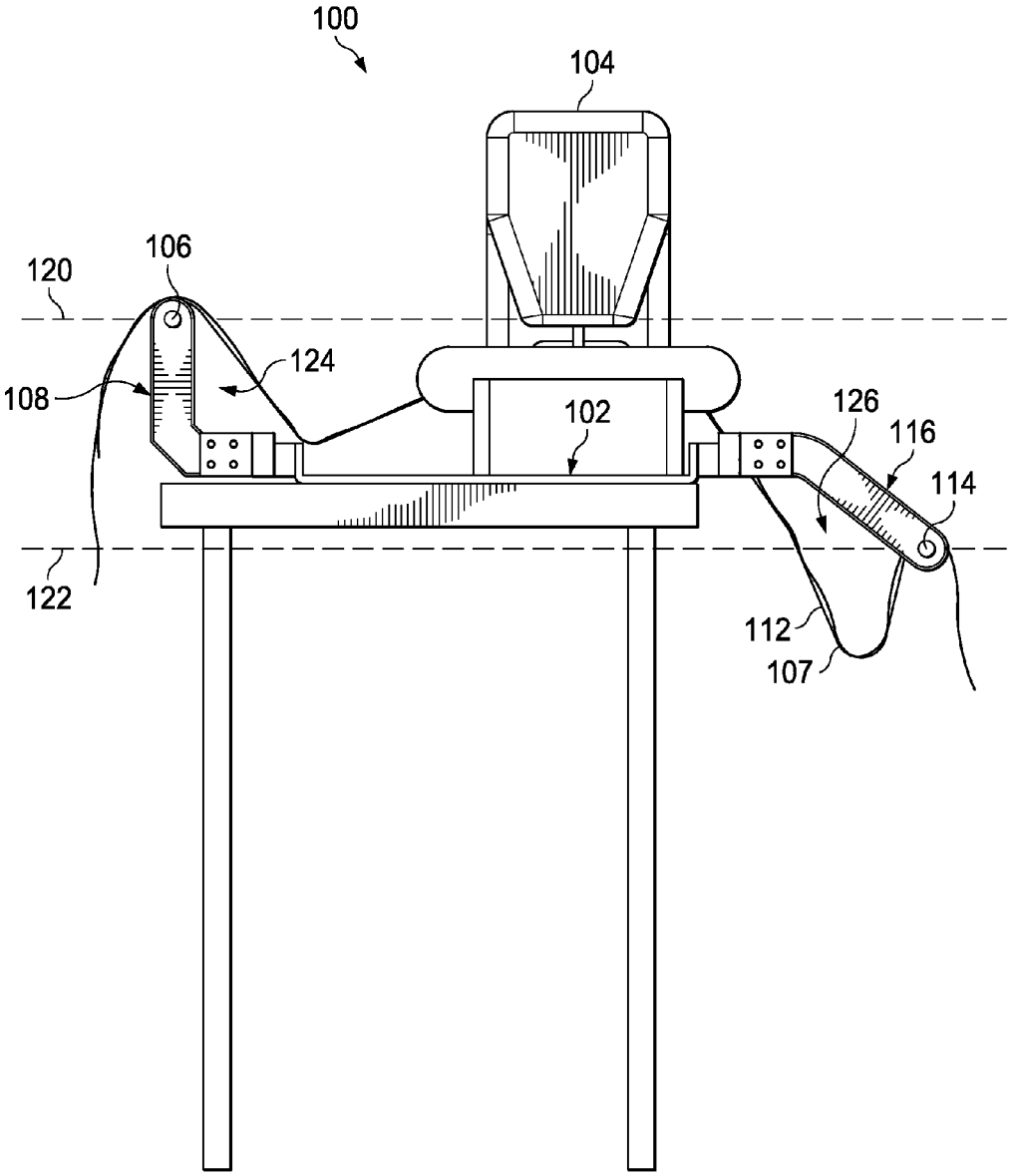
FIG. 3 is a schematic side-view of the quilt support, embroidery machine and quilt sandwich of FIG. 2.

Referring now to FIGS. 1-3, an illustrative embodiment of a quilt support 100 is shown. The quilt support 100 includes a platform 102 for supporting an embroidery machine 104. The embroidery machine 104 may be configured to quilt a quilt sandwich 107. Additionally, in one embodiment, the embroidery machine 104 may be employed to apply embroidery to the quilt sandwich 107. While a quilt sandwich is the workpiece employed in the illustrative embodiment, it will be appreciated that any suitable item may be quilted and remain within the scope of the disclosure including, but not limited to, any suitable workpiece formed from any suitable material having any suitable number of layers, etc. Therefore, the term "quilt sandwich" should be understood broadly so as to encompass any suitable stitchable workpiece formed from any suitable material(s) having any suitable number of layers.

Figure 7:
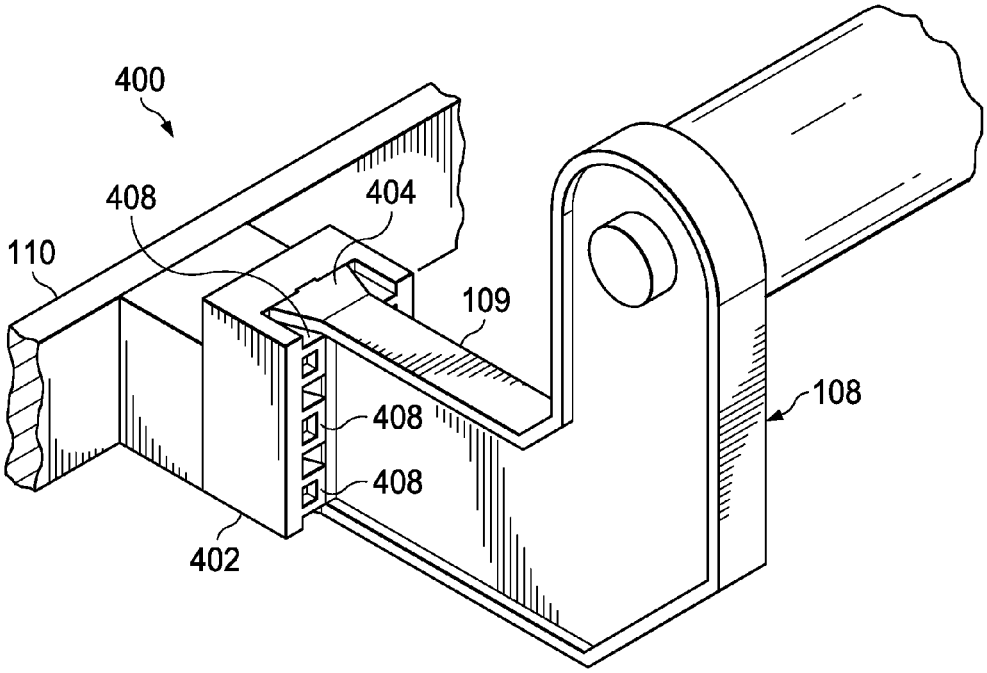
FIG. 7 is a schematic environmental view of a coupling device.
Figure 8:
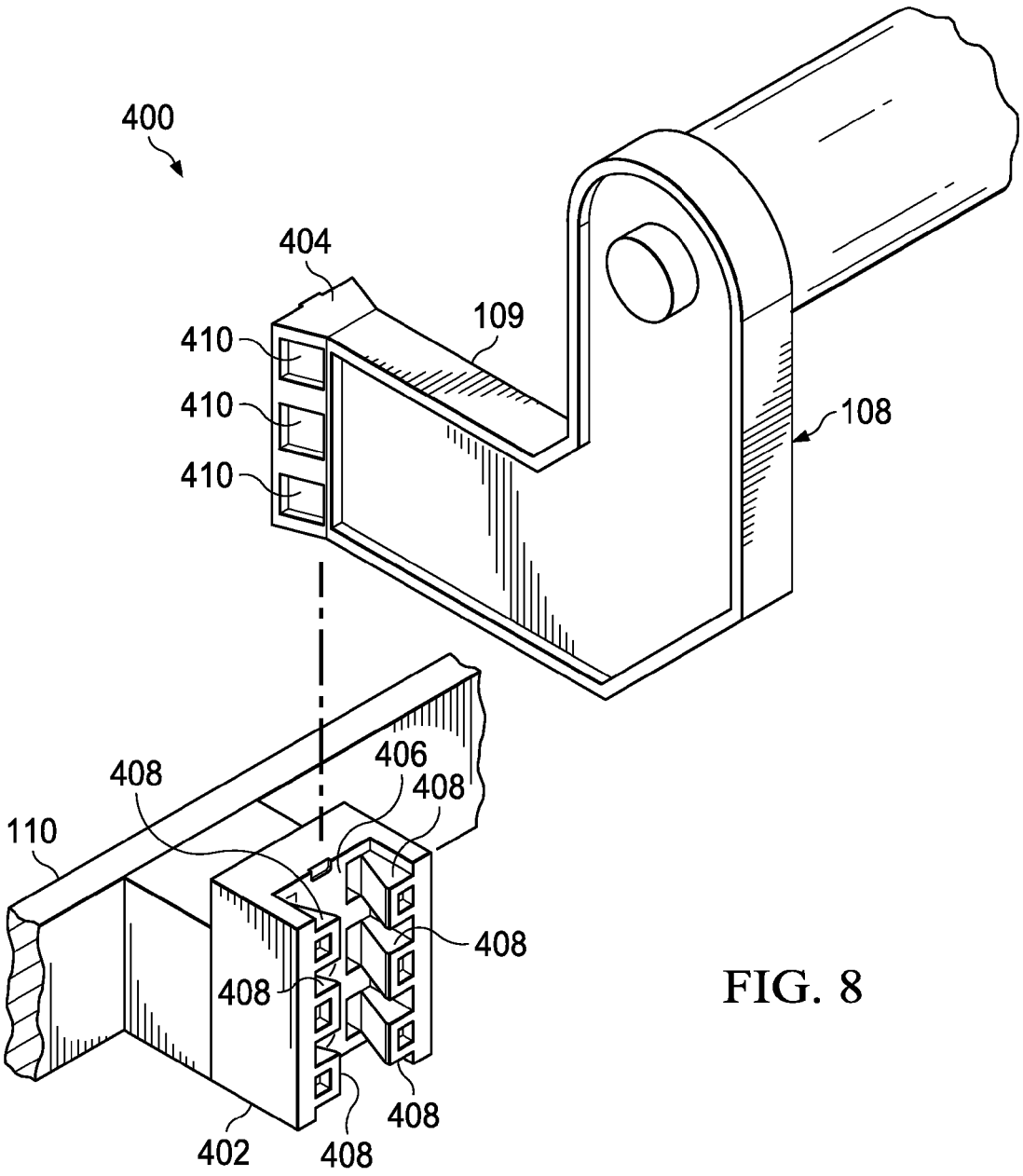
FIG. 8 is a schematic environmental view of the coupling device of FIG. 7 showing the first portion of the coupling device disengaged from the second portion of the coupling device.

A first support arm 106 is coupled to the platform 102. In one embodiment, a first bracket member 108, comprising a first segment 109 and a second segment 111, is operable to couple the support arm 106 to an extension 110 of the platform 102. In one embodiment, as best shown in FIGS. 7 and 8, the first bracket member 108 may be releasably coupled to the extension 110 of the platform 102 by way of one or more coupling devices 400. Each coupling device includes a first portion 402 secured to the extension 110 of the platform 102 and a second portion 404 secured to the first segment 109 of the first bracket member 108. The first portion 402 includes an opening 406 for releasably receiving the second portion 404. The opening 406 and the second portion 404 may be complimentarily shaped such that the second portion 404 may be snugly and releasably received within the opening 406. Further, the first portion may include one or more protrusions 408 to be releasably received by one or more corresponding apertures 410 of the second portion 404. The second portion 404 may be disposed within the opening 406 of the first portion 402 such that the one or more protrusions 408 are each releasably received by a corresponding aperture 410 of the second portion 404. It will be appreciated that the second segment 111 of the first bracket member 108 may also include a second portion 404 of another coupling device secured thereto wherein this second portion 404 is capable of being releasably received by a corresponding first portion 402 also secured to the extension 110 of the platform 102. However, it will be appreciated that the first support arm 106 and/or first bracket member 108 may be releasably coupled to the platform 102 via any suitable means or device and remain within the scope of the present disclosure. Further, it will be appreciated that the support arm 106 and/or first bracket member 108 may be rigidly coupled to the platform via any suitable means or device and remain within the scope of the present disclosure.

The first support arm 106 is configured to support at least one of a portion of the quilt sandwich 107 and at least a portion of a header fabric 112. In one embodiment, the support arm 106 is a roller for receiving at least one of a portion of the quilt sandwich 107 and at least a portion of a header fabric 112 thereon or thereabouts. However, it will be appreciated that the support arm 106 may be a rod or any other suitable device or structure that either the quilt sandwich and/or header fabric may be wrapped around and/or draped over such that the quilt sandwich and/or header fabric are supported.

A second support arm 114 is also coupled to the platform 102. In one embodiment, a second bracket member 116, comprising a first segment 117 and second segment 119, is operable to couple the support arm 114 to an extension 118 of the platform 102. The second bracket member 116 may be releasably coupled to an extension 118 of the platform 102 by way of one or more coupling devices 400 as previously described with respect to FIGS. 7 and 8. However, it will be appreciated that the second support arm 114 and/or second bracket member 116 may be releasably or rigidly coupled to the platform 102 via any suitable means or device and remain within the scope of the present disclosure.

The second support arm 114 is configured to support at least one of a portion of the quilt sandwich 107 and at least a portion of a header fabric 112. In one embodiment, the second support arm 114 is a roller for receiving at least one of a portion of the quilt sandwich 107 and at least a portion of a header fabric 112 thereon or thereabouts. However, it will be appreciated that the support arm 114 may be a rod or any other suitable device or structure that either the quilt sandwich and/or header fabric may be wrapped around and/or draped over such that the quilt sandwich and/or header fabric are supported. As used herein, the term "coupled" includes coupling via a separate object and includes direct coupling. The term "coupled" also encompasses two or more components that are continuous with one another by virtue of each of the components being formed from the same piece of material. Also, the term "coupled" may include chemical, such as via a chemical bond, mechanical, thermal, magnetic, or electrical coupling. Also, unless otherwise provided, "coupled" includes both permanent coupling as well as selectively releasable coupling.

The second support arm 114 is offset from the first support arm 106 such that the platform 102 and embroidery machine 104 are between the first support arm 106 and second support arm 114. In the illustrative embodiment, the first and second support arms 106, 114 are parallel with one another. However, it will be appreciated that the support arms 106, 114 may be at any suitable angle relative to one another and remain within the scope of the present disclosure. Also, in the illustrative embodiment, the first support arm 106 is in a first horizontal plane 120 and the second support arm 114 is in a second horizontal plane 122 offset from the first horizontal plane 120. However, it will be appreciated that the first support arm 106 and second support arm 114 may be in the same horizontal plane and remain within the scope of the present disclosure. Further, it will be appreciated that one or both of the support arms 106, 114 may be in a horizontal plane substantially co-planar with the work area 128 of the embroidery machine 104, in a plane above the work area 128 of the embroidery machine 104, in a plane below the work area 128 of the embroidery machine 104, or any other suitable arrangement or suitable combination thereof.

Further, in one embodiment, the first support arm 106 and second support arm 114 are each releasably coupled to their respective bracket members 108, 116, wherein the first support arm 106 is supported in a first position (e.g. on one side of the embroidery machine 104) and wherein the second support 114 arm is supported in a second position (e.g. on another side of the embroidery machine 104). The bracket members may include slots or any other suitable configuration or device(s) to accommodate this releasable coupling. Further, the first support arm 106 and second support arm 114 may be selectively removed from their respective bracket members 108, 116. The first support arm 106 may then be received by the second bracket member 116 so that the first support arm 106 is maintained in the aforementioned second position and the second support arm 114 received by the first bracket member 108 so that the second support arm 114 is maintained in the aforementioned first position. In this manner, the support arms 106, 114 may effectively swap positions so that access may be provided to a different portion of the workpiece.

In use, a quilt sandwich 107 is coupled to the header fabric 112 and arranged such that the quilt sandwich 107 is in position to be quilted by the embroidery machine 104 in the work area 128 of the embroidery machine 104 (see e.g. FIG. 1). In one embodiment, at least one of a portion of the quilt sandwich 107 or a portion of the header fabric 112 is supported by first support arm 106 such that a portion of the quilt sandwich 107 and/or header fabric 112 not receiving embroidering drapes into the space 124 between the first support arm 106 and embroidery machine 104 so that the portion(s) so draped are below the work area 128 of the embroidery machine. Similarly, at least one of a portion of the quilt sandwich 107 and a portion of the header fabric 112 is supported by second support arm 114 such that a portion of the quilt sandwich 107 and/or header fabric 112 not receiving quilting drapes into the space 126 between the second support arm 114 and embroidery machine 104 so that the portion(s) so draped are below the work area 128 of the embroidery machine. Next, the quilt sandwich 107 may receive quilting from the embroidery machine 104. The quilt sandwich 107 and header fabric 112 may then be moved parallel with the support arms 106, 114 so that another area may receive quilting. Alternatively, the quilt sandwich 107 may be moved perpendicularly relative to the support arms 106, 114 and towards one of the support arms 106, 114 so as to expose another area for quilting and such that one support arm 106, 114 supports additional material (i.e. quilt sandwich and/or header fabric) and the other support arm 106, 114 supports less material. Further, as described above, the first support arm 106 and second support arm 114 may swap positions such that the first support arm 106 is supported by the second bracket member 116 and the second support arm 114 is supported by the first bracket member 108. Once the quilt sandwich 107 has received the desired quilting, the quilt sandwich 107 may be removed from the header fabric 112. Also, while the illustrative embodiment shows a header fabric 112, it will be appreciated that the quilt sandwich 107 may be quilted without employing such a header fabric 112.

Figure 4:
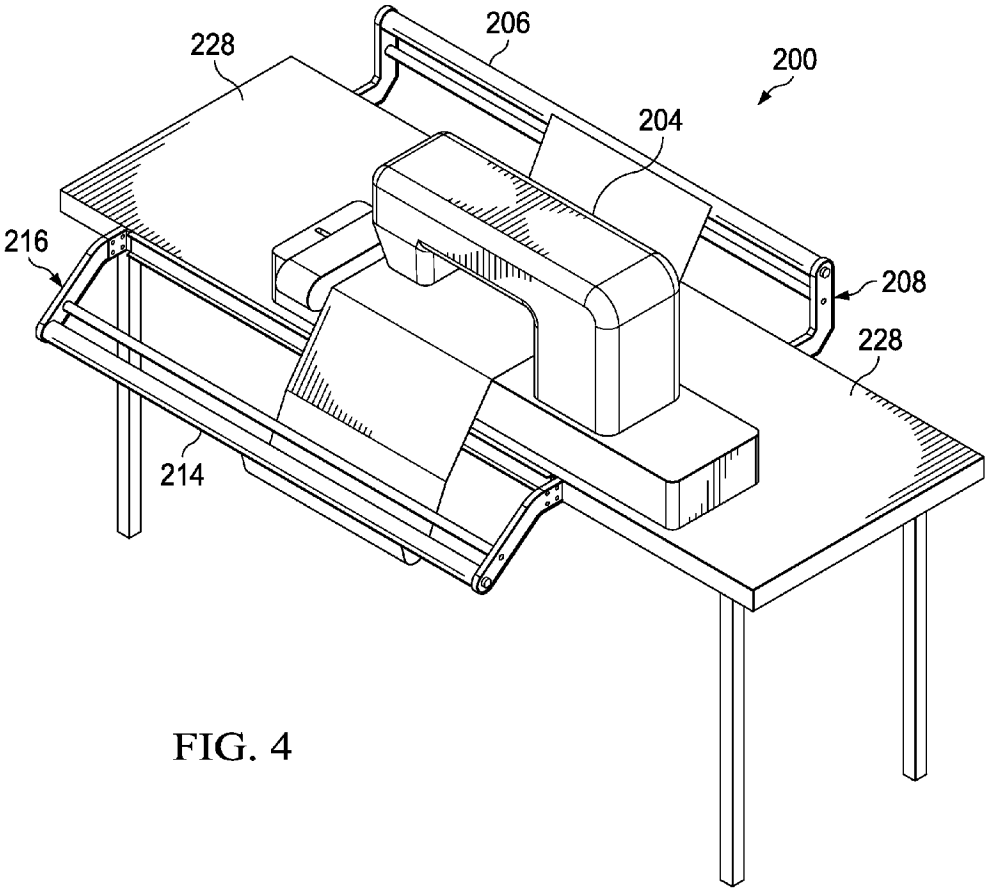
FIG. 4 is a schematic perspective view of a quilting system.

Referring now to FIG. 4, an illustrative embodiment of an alternative quilt support 200 is shown. Elements of FIG. 4 that are analogous to elements in FIGS. 1-3 have been shown by indexing the reference numerals by 100. In FIG. 4, the support arms 206, 214 are coupled to a support structure, such as a table 228, supporting the embroidery machine 204. As such, the platform 102 of FIGS. 1-3 has been eliminated. Otherwise, the quilt support 200 functions similarly to that of FIG. 1-3. Further, in one embodiment, the support arms 206, 214 may be coupled to the support structure via corresponding bracket members 208, 216 wherein the bracket members 208, 216 are rigidly coupled to the support structure or, alternatively, releasably coupled to the support structure by way of coupling devices similar to those previously described and shown in FIGS. 7 and 8.

Figure 5:
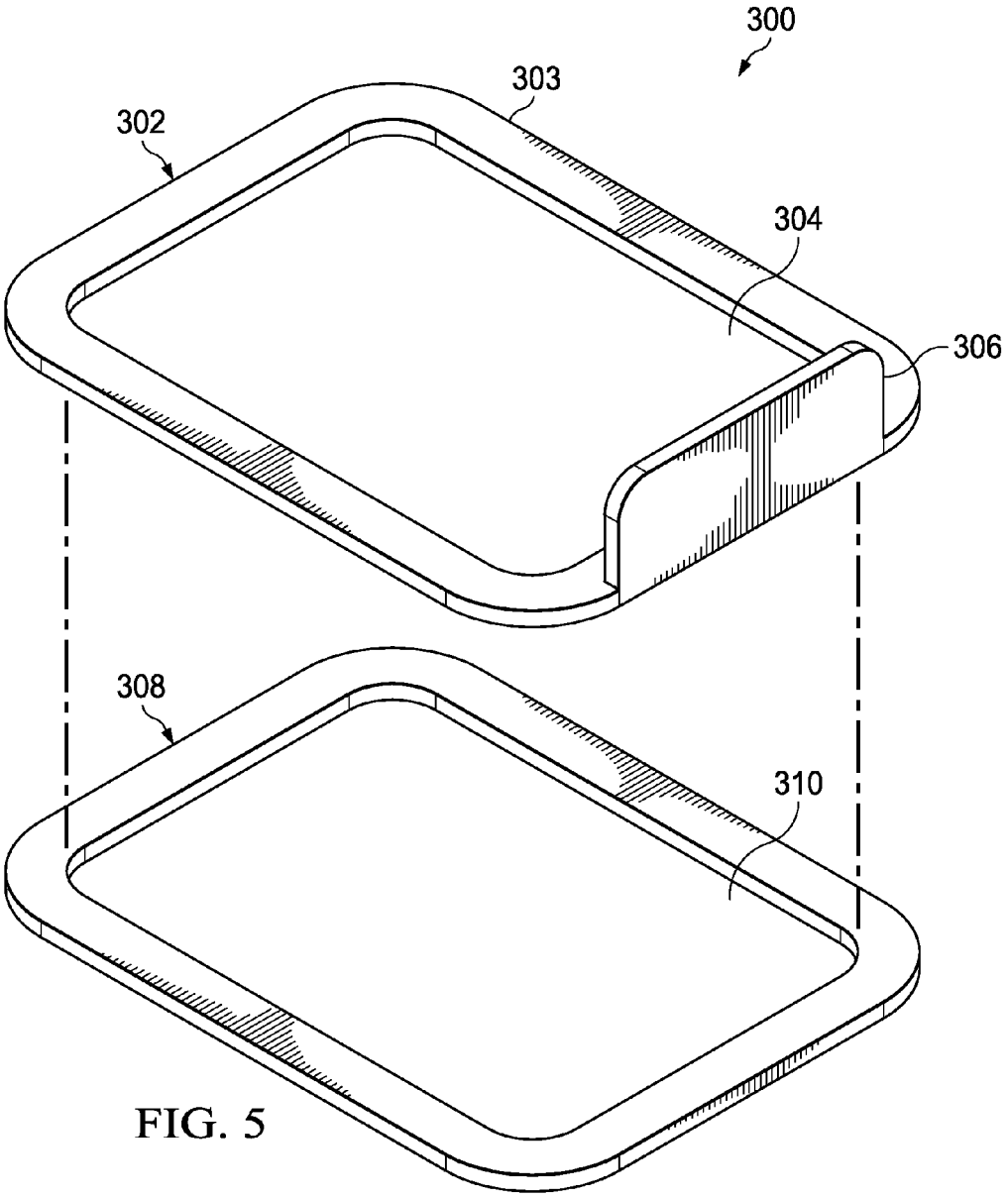
FIG. 5 is a schematic perspective view of a hoop.
Figure 6:
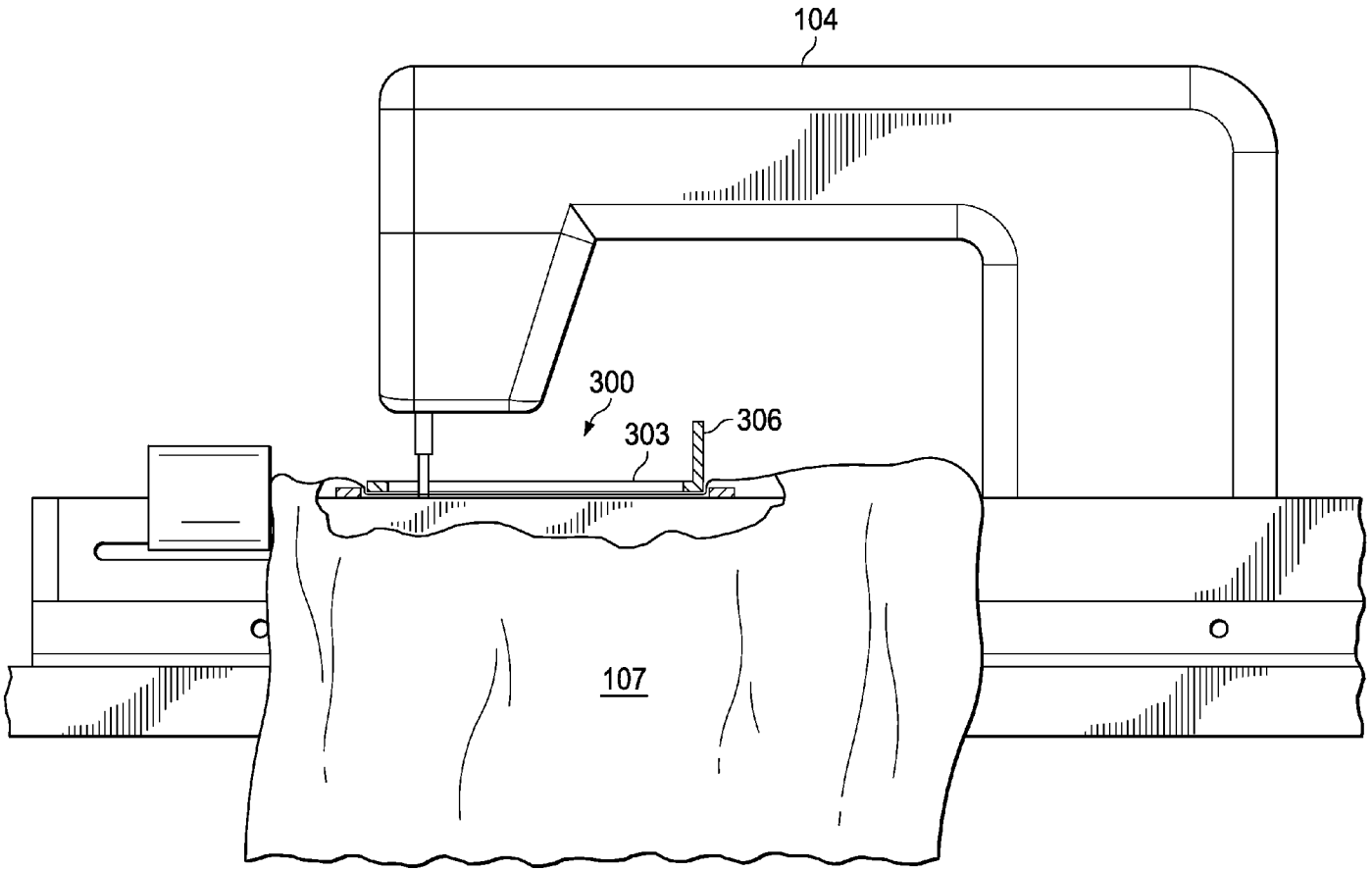
FIG. 6 is a schematic environmental view of the hoop of FIG. 5.

Referring now to FIGS. 2, 5 and 6, a hoop 300 is shown. The hoop 300 includes a first frame 302 having a frame portion 303 defining a work area 304. In one non-limiting embodiment, an extension 306 may be coupled to the frame portion 303. The extension 306 may be operable to prohibit a portion of the quilt sandwich 107 not in the work area 304 from falling within the work area 304 so that only material in the work area 304 receives quilting. The hoop 300 further includes a second frame 308 having an opening 310. In use, the second frame 308 is disposed within the work area 128 of the embroidery machine 104. The quilt sandwich 107 having the header fabric 112 coupled thereto may be placed atop the second frame 308. The first frame 302 may then be positioned in substantial circumscribing alignment with the second frame 308. The portion of the quilt sandwich 107 within the work area 304 of the hoop 300 may then be quilted by the embroidery machine 104. In one embodiment, the first frame 302 and second frame 308 are formed from a magnetic material so that the frames 302, 308 may be magnetically coupled with the quilt sandwich 107 therebetween. However, it will be appreciated that the hoop 300 may be formed from any suitable material and remain within the scope of the present disclosure. Also, the frames 302, 308 may be releasably coupled to one another using any coupling technique, and are not limited to magnetic coupling. Additionally, it will be appreciated that the hoop 300 is shown in the context of the quilt support 100 of FIG. 2 for illustrative purposes only and that the support 100 of FIGS. 1-3 does not require the hoop 300 so illustrated. Indeed, any suitable hoop may be employed and remain with in the scope of the present disclosure. Alternatively, no hoop may be employed and remain within the scope of the present disclosure.

Although the illustrative embodiments described herein have been disclosed in the context of certain illustrative, non-limiting embodiments, it should be understood that various changes, substitutions, permutations, and alterations can be made without departing from the scope of the invention as defined by the appended claims. It will be appreciated that any feature that is described in a connection to any one embodiment may also be applicable to any other embodiment.

What is claimed is:

1. A quilt support comprising:

a stationary platform having a flat top surface, a first side, and a second side that is opposed to the first side, wherein the flat top surface of the stationary platform is configured to support a bottom surface of a stationary embroidery machine, the stationary embroidery machine capable of quilting a quilt sandwich;

a first support arm coupled to and extending outwardly from the first side of the stationary platform, the first support arm adapted to support a portion of the quilt sandwich;

a second support arm coupled to and extending outwardly from the second side of the stationary platform, the second support arm offset from the first support arm and adapted to support a portion of the quilt sandwich;

wherein the stationary platform is stationary with respect to the first support arm and the second support arm;

wherein the stationary platform is completely between the first support arm and the second support arm; and a hoop for use with the embroidery machine.

2. The quilt support of claim 1 wherein the first support arm comprises a roller for receiving at least a portion of the quilt sandwich.

3. The quilt support of claim 1 wherein the second support arm comprises a roller for receiving at least a portion of the quilt sandwich.

4. The quilt support of claim 1 wherein the first support arm is parallel with the second support arm.

5. The quilt support of claim 1 wherein the first support arm and second support arm are in the same horizontal plane.

6. The quilt support of claim 1 wherein the first support arm and second support arm are in different horizontal planes.

7. The quilt support of claim 1 wherein the first support arm and second support arm are each releasably coupled to the stationary platform.

8. The quilt support of claim 1 wherein the first support arm is coupled to the stationary platform by way of a first bracket member, the first bracket member comprising a first segment and a second segment, wherein the first segment of the first bracket member is coupled to the stationary platform and wherein the second segment of the first bracket member is coupled to the stationary platform and wherein the first support arm extends between the first and second segments of the first bracket member.

9. The quilt support of claim 8 wherein the first and second segments of the first bracket member are each releasably coupled to the stationary platform by way of corresponding coupling devices, wherein each coupling device comprises a first portion secured to the stationary platform and a second portion secured to a corresponding first or second segment of the first bracket member, wherein the first portion of the coupling device is adapted to releasably receive the second portion of the coupling device.

10. The quilt support of claim 1 further comprising a header fabric extending from the first support arm to the second support arm, wherein the quilt sandwich is coupled to the header fabric prior to receiving quilting.

11. A quilting system comprising:

a stationary embroidery machine capable of quilting a quilt sandwich, the stationary embroidery machine comprising a rectangle in plan view with a first long side, a first short side, a second long side, and a second short side;

a first support arm parallel to the first long side of the stationary embroidery machine, the first support arm adapted to support a portion of the quilt sandwich;

a second support arm parallel to the second long side of the stationary embroidery machine and offset from the first support arm such that the first and second long sides of the stationary embroidery machine are between the first support arm and second support arm, the second support arm adapted to support a portion of the quilt sandwich;

wherein the stationary embroidery machine is stationary with respect to the first support arm and the second support arm; and a hoop for use with the stationary embroidery machine.

12. The quilting system of claim 11 wherein the first support arm comprises a roller for receiving at least a portion of the quilt sandwich.

13. The quilting system of claim 11 wherein the second support arm comprises a roller for receiving at least a portion of the quilt sandwich.

14. The quilting system of claim 11 wherein the first support arm and second support arm are in the same horizontal plane.

15. The quilting system of claim 11 wherein the first support arm and second support arm are in different horizontal planes.

16. The quilting system of claim 11 wherein the hoop further comprises:

a first frame, the first frame comprising a frame portion defining an interior work area, and an extension extending from the frame portion, the extension operable to prevent at least a portion of the quilt sandwich from entering the work area;

a second frame, wherein the first frame is positionable in circumscribing alignment with the second frame after the quilt sandwich has been placed atop the second frame; and wherein the hoop is only attached to the quilt sandwich.

* * * * *